US005204647A

United States Patent [19]

Nagamoto et al.

[11] Patent Number: 5,204,647

[45] Date of Patent: Apr. 20, 1993

[54] ELECTROMAGNETIC RELAY

[75] Inventors: Mitsuki Nagamoto, Tsu; Shigeru Yokota, Tamaki, both of Japan

[73] Assignee: Matsushita Electric Works, Ltd., Osaka, Japan

[21] Appl. No.: 782,593

[22] Filed: Oct. 25, 1991

[30] Foreign Application Priority Data

Oct. 26, 1990 [JP] Japan ..... 2-112730[U]

[51] Int. Cl.[5] ..... H01H 51/22

[52] U.S. Cl. ..... 335/80; 335/128; 335/131

[58] Field of Search ..... 335/78-86, 335/124, 128, 131-133

[56] References Cited

U.S. PATENT DOCUMENTS 4,302,742 11/1981 Schedele .
4,825,179 4/1989 Nagamoto et al. ..... 335/80

FOREIGN PATENT DOCUMENTS 2912800 10/1980 Fed. Rep. of Germany .
3219131 11/1983 Fed. Rep. of Germany .
3808558 9/1988 Fed. Rep. of Germany .

*Primary Examiner*—Lincoln Donovan
*Attorney, Agent, or Firm*—Stevens, Davis, Miller & Mosher

[57] ABSTRACT

An electromagnetic relay has a contact assembly and an electromagnet arranged in side-by-side relation within a housing along its length. The contact assembly includes a fixed contact and a movable contact. The electromagnet includes an excitation coil and an armature movable between two contact operating positions in response to energization and deenergization of the coil. The armature is coupled through a card to the movable contact for engaging and disengaging it to and from the fixed contact in response to the armature movement. A partition extends between the electromagnet and the contact assembly in a width direction of the housing for electrical insulation therebetween. The card has an extended width formed along the width of the partition. The partition has a slit extending in the width direction for receiving the full width of the card such that the card can slide through the slit for contact closing and opening in response to the armature movement. A guide member is formed on the partition along one width end of the slit and projects in the sliding direction of the card so as to define an extended guide in cooperation with the one width end of the slit for slidably supporting a corresponding one width end portion of the card over an extended distance in the sliding direction. The card is engaged at the other width end portion spaced from the guide member with the armature in such a manner that the armature can move without being interfered with the guide member.

2 Claims, 5 Drawing Sheets 31
33
35
50
52
51
40
32
34
36
38
37
39
60
61
62
63
13
14
15
12
10
16
17
18
21
20
22

61
54
53
60
32
38
62
50
52
21

61
54
53
60
32
38
62
50
52
21

50
60
62
38
32
34
37
63
61
53
21

50
60
62
38
32
34
37
63
61
53
54
21

ELECTROMAGNETIC RELAY

BACKGROUND OF THE INVENTION

1. Field of the Invention

The present invention is directed to an electromagnetic relay with a card transmitting an armature movement to a movable contact for contact closing and opening, and particularly to a miniature relay with a space saving card supporting and driving structure.

2. Description of the Prior Art

There have been proposed in the art a number of electromagnetic relays with a card interconnecting an armature and a movable spring carrying a movable contact for converting the armature movement into contact closing and opening movement of the movable spring. For example, U.S. Pat. No. 4,825,179 discloses a typical electromagnetic relay in which the card is supported by a partition which is provided for electrical insulation between an electromagnet and a contact assembly arranged in a side-by-side relation along a length of a relay housing. The electromagnet comprises an armature movable between two contact operating positions in response to energization and deenergization of an excitation coil. The contact assembly includes the movable spring and the fixed contact. The card is slidably supported to the partition such that it is allowed to move along the length of the housing through the partition and act on the movable spring for engaging and disengaging the movable contact to and from the fixed contact in response to the armature movement. In order to stably support the card, the partition is specifically designed to have a pair of slits spaced in the sliding direction of the card so that the card can be supported at two spaced points in the sliding direction of the card with one end of the card projecting away from the slit into abutment with the armature and with the other end of the card projecting into abutment with the movable spring. That is, the two slits are aligned in the sliding direction of the card with the engaging portion between the armature and the card. However, this structure requires an extra amount of projection of the card toward the armature to such an extent that the armature will not conflict with the partition in its forward stroke of moving the card outwardly for contact closing. Such extra amount of projection therefore adds a correspondingly increased dimension to the card supporting and driving structure or the overall lengthwise dimension, which imposes a limitation on the miniaturization of the relay, particularly, in the lengthwise dimension thereof.

SUMMARY OF THE INVENTION

In view of the above problem, the present invention has been accomplished to successfully reduce the lengthwise dimension of the card supporting and driving structure for the relay having the card transmitting an armature movement to a movable contact for contact closing and opening. An electromagnetic relay in accordance with the present invention comprises a contact assembly and an electromagnet arranged in side-by-side relation within a housing along a length thereof. The contact assembly includes a fixed contact and a movable spring carrying a movable contact. The electromagnet includes an excitation coil and an armature movable between two contact operating positions in response to energization and deenergization of the excitation coil. The armature is coupled through the card to the movable spring for engaging and disengaging the movable contact to and from the fixed contact in response to the armature movement. A partition is provided to extend between the electromagnet and the contact assembly in a width direction of the housing for electrical insulation therebetween. The card has an elongated width extending along the width of the partition. The partition is formed with a slit extending in the width direction thereof for receiving the full width of the card such that the card can slide through the slit for contact closing and opening in response to the armature movement. The partition has a guide member formed along one width end portion of the slit and projecting in the sliding direction of the card so as to define an extended guide in cooperation with the one width end portion of the slit for slidably supporting one corresponding width end portion of the card over an extended distance in the sliding direction. The card is engaged at the other width end portion spaced from the guide member with the armature in such a manner that the armature can move without being interfered with the guide member. In other words, the armature is allowed to move past the portion of the guide member in the sliding direction of the card without being interfered with the guide member so as to give a sufficient travel distance to the card for contact closing and opening, yet stably supporting the card by the extended guide during its sliding movement. Whereby, it is possible to reduce the lengthwise dimension required for supporting and driving the card in the sliding direction.

Accordingly, it is a primary object of the present invention to provide an electromagnet relay which is capable of reducing the supporting and driving structure of the card in its sliding direction to thereby successfully miniaturize the relay in the lengthwise dimension thereof.

In a preferred embodiment, the card is in the form of an extended flat plate with a nose extension which projects in the sliding direction of the card from one width end of the flat plate remote from the guide member for abutment with the movable spring while leaving the remaining width end portion of the flat plate to be slidably supported by the extended guide, such that the engaging portion of the armature with the said card is aligned in the sliding direction of the card with the engaging portion of the card with the movable spring. The nose extension projects by a sufficient but minimum distance for abutment with the movable spring, which ensures to reliably driving the movable spring for contact closing and opening, in addition to that the armature and the movable spring are engaged with the opposite portions of the card aligned in the sliding direction of the card.

It is therefore another object of the present invention to provide an electromagnetic relay which is capable of effecting contact closing and opening reliably with the card interposed between the armature and the movable spring, yet retaining the above feature of minimizing the card supporting and driving structure.

The card is configured to have a pair of vertical fins which project from the connection between the flat plate and the nose extension in opposite directions substantially perpendicular to a plane of said flat plate and are located outwardly of the slit so as to conceal the slit therebehind. The card is engaged at a portion opposite of the nose extension with a leg of the armature which is dimensioned to have substantially the same width as the width of said vertical fin in the width direction of the card. Thus, the armature leg can be effectively insulated by the vertical fins from the associated movable spring or the contacts for reliable relay operation, which is therefore a further object of the present invention.

These and still other objects and advantages will become more apparent from the following detailed description of the preferred embodiment of the present invention when taken in conjunction with the attached drawings.

DESCRIPTION OF THE PREFERRED EMBODIMENT

Figure 1:
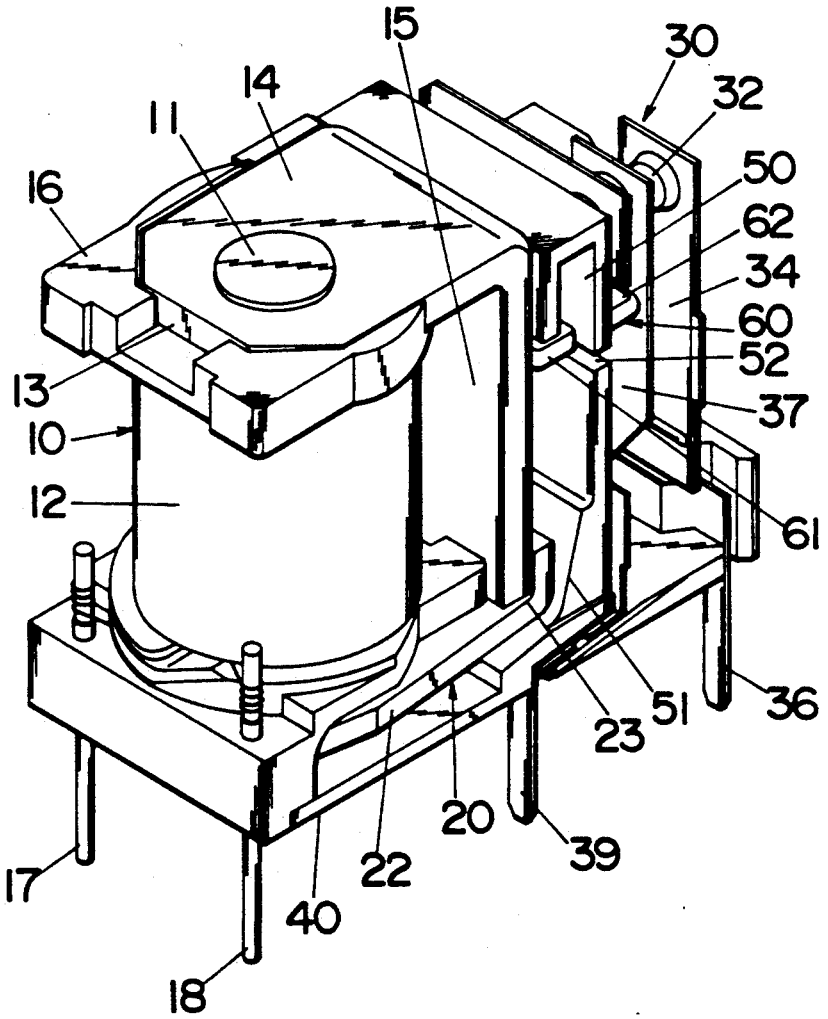
FIG. 1 is a perspective view of an electromagnetic relay with a cover being removed in accordance with a preferred embodiment of the present invention.
Figure 2:
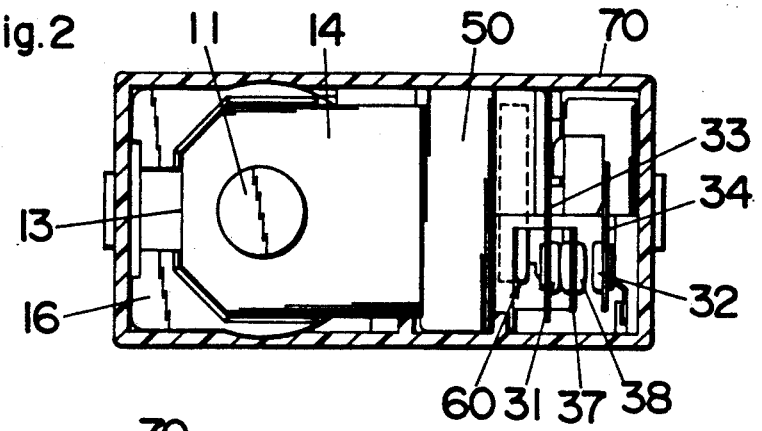
FIG. 2 is a top view, partly in section, of the relay.
Figure 3:
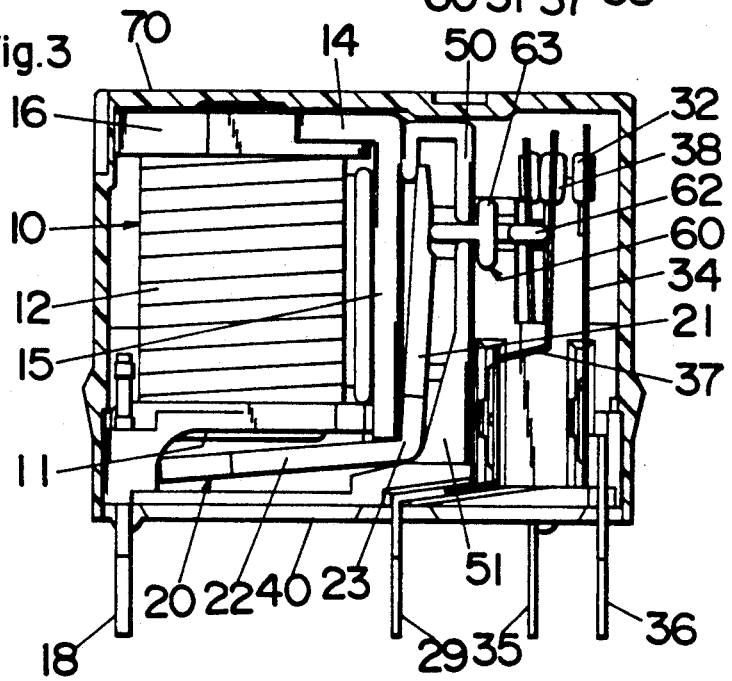
FIG. 3 is a front view, partly in section, of the relay with its armature shown in its reset position.
Figure 4:
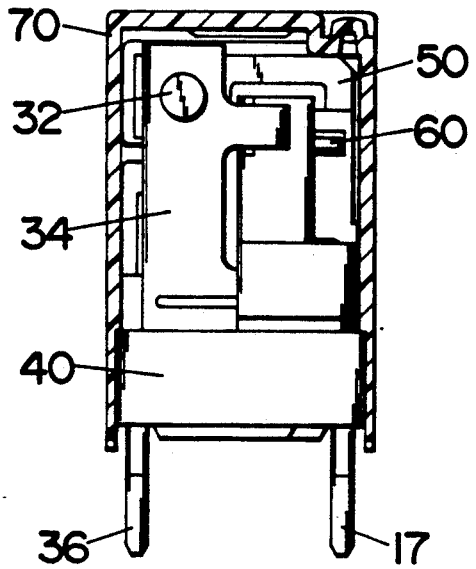
FIG. 4 is a right side view, partly in section, of the relay.
Figure 5:
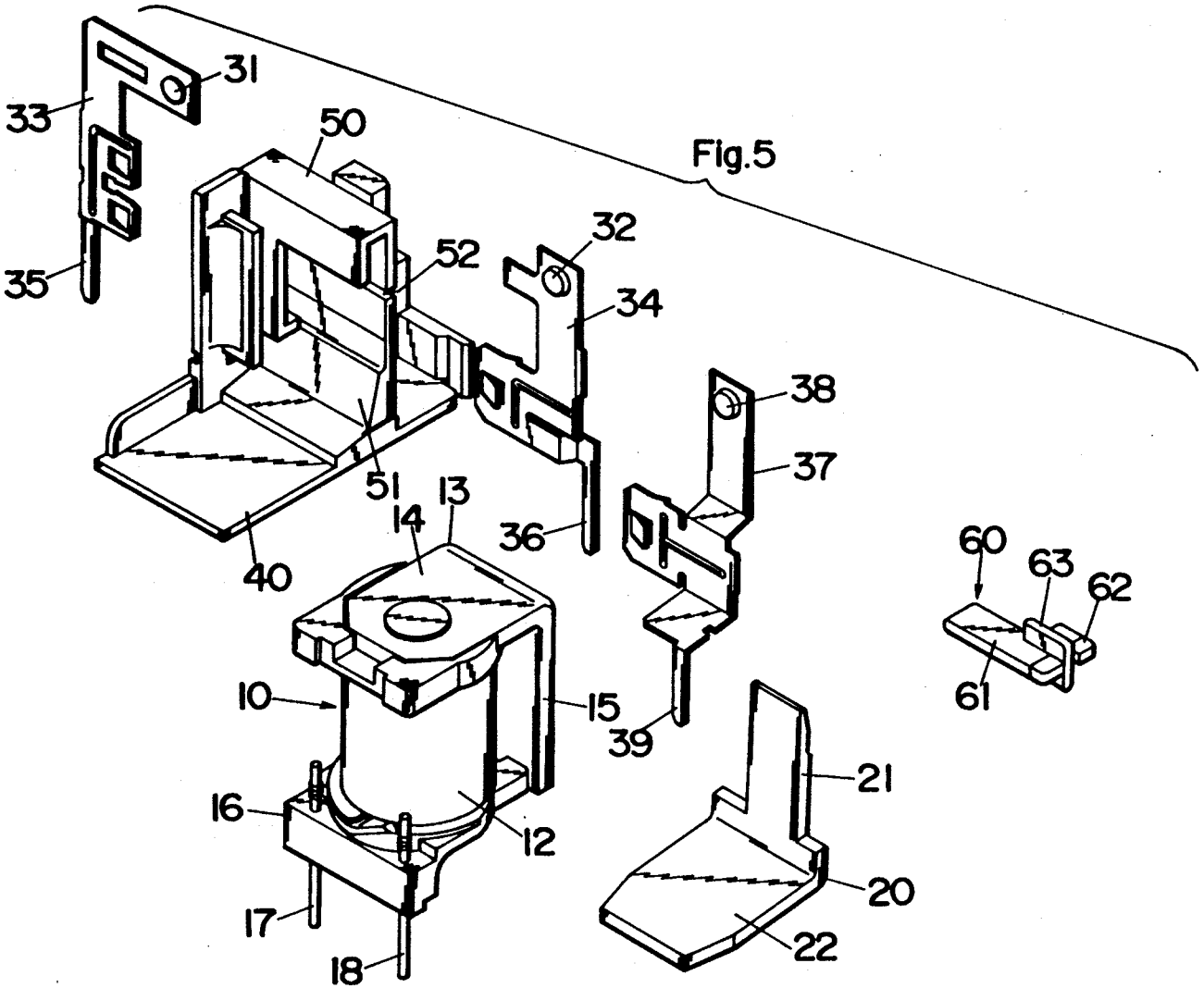
FIG. 5 is an exploded perspective view of a major portion of the relay.

Referring now to FIGS. 1 to 5, a miniature electromagnetic relay comprises an electromagnet 10 and a contact assembly 30 mounted on a rectangular base 40 molded from an electrically insulating material in side-by-side relation along a length of the base 40. A cover 70 also formed of electrically insulative material is fitted on the base 40 to define a relay housing and form therein a sealed interior space for accommodating the electromagnet 10 and the contact assembly 30. A partition 50 projects on the base 40 and extends the full width of the housing or base 40 in order to divide the sealed space into a magnet compartment 41 for the electromagnet 10 and a contact compartment 42 for the contact assembly 30. The electromagnet 10 includes a core 11, an excitation coil 12 wound about the core 11, a yoke 13, and a L-shaped armature 20. The core 11 extends through a coil bobbin 16 fixed on the base 40 and carrying thereabout the coil 12. The ends of the coil 12 are connected to the upper ends of coil terminals 17 and 18 which are molded in the bobbin 16 and have their respective lower ends extending vertically through the base 40. The yoke 13 is formed into a L-shaped configuration with a horizontal segment 14 connected to one end of the core 11 and an upright segment 15 extending parallel to the core 11. The armature 20 is formed into a generally L-shaped configuration with a first leg 21 and a second leg 22 bent at an obtuse angle to each other. The first leg 21 extends along the upright yoke segment 15 so that the second leg 22 extends over the other end of the core 11 to define therebetween a air gap. The armature 20 is rockable with its inside angle 23 bearing against an edge at the free end of the upright yoke segment 15 for movement between a set position and a reset position upon energization and deenergization of the excitation coil 12, respectively.

Integrally formed at the lower end of the partition 50 is an angular rib 51 which is opposed to the yoke edge and defines therebetween a gap for loosely retaining therein the angled portion of the armature 20. The rounded inner angle surface of the rib 51 has a radius centered at the yoke edge. The gap distance is selected to be great enough to facilitate the assembly of the armature 20 but is limited to such an extent that the inside angle 23 of the armature 20 is within an allowable distance from the yoke edge. By the allowable distance is meant that upon the energization of the coil 12 the armature 20 can be corrected its position to have its inside angle 23 into coincidence with the yoke edge before the armature 20 moves to the set position.

The contact assembly 30 comprises a pair of first and second fixed contacts 31 and 32, and a movable spring 37 carrying thereon a movable contact 38 engageable with either of the first or second fixed contact. The fixed contacts 31 and 32 are held respectively on elongated springs 34 and 35 which are fixed to the base 40 with integrally formed terminals 35 and 36 extending downwardly through the base 40. The movable spring 37 is fixed at one end to the base 40 with an integrally formed terminal 39 extending downwardly through the base 40. The movable spring 37 is self-biased in a direction away from the second fixed contact 32 to the first fixed contact 31 and is connected to the first armature leg 21 through an actuator card 60 so as to apply a return bias to the armature 20 while holding the actuator card 60 between the movable spring 34 and the first armature leg 21. Thus, the first fixed contact 31 defines a normally closed contact while the second fixed contact 32 defines a normally open contact as the movable contact 38 is driven by the armature 20 through the actuator card 60 to move from the first fixed contact 31 to the second fixed contact 32 in response to the energization of the coil 12 and returns from the second to first fixed contact by the spring bias of the movable spring 37 upon deenergization of the coil 12. The return bias from the movable spring 37 acts to place the armature 20 into a correct position for pivotal movement between the set and reset positions.

Figure 7:
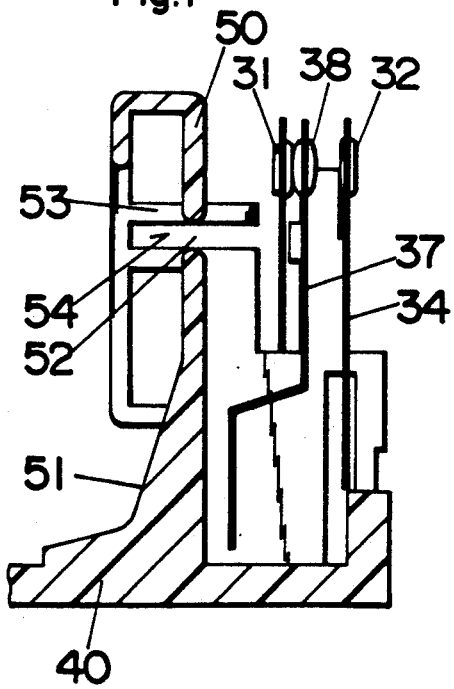
FIG. 7 is a partial front view showing the supporting structure of the card.
Figure 8A:
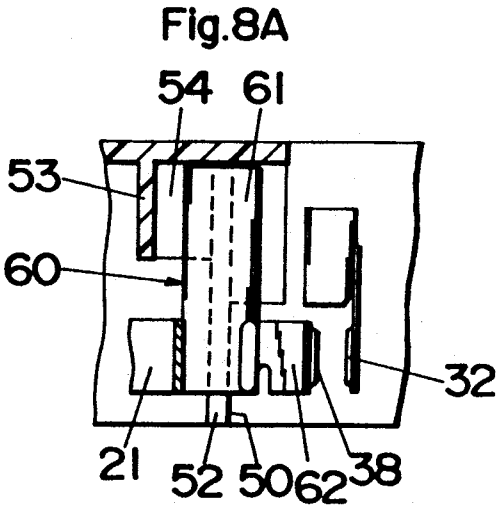
FIGS. 8A and 8B are respectively explanatory views illustrating the card movement for contact closing and opening as viewed from the above.
Figure 8B:
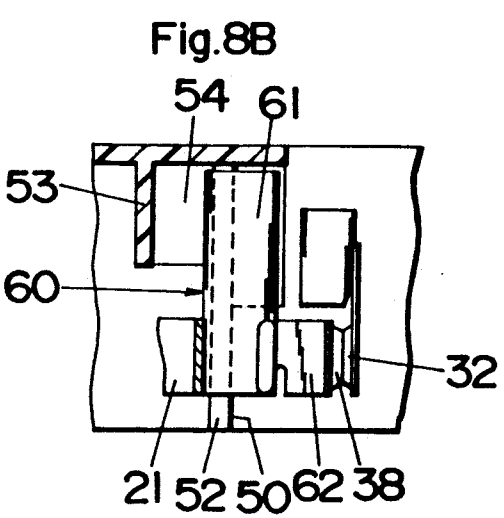

Formed along substantially the full width of the partition 50 is a slit 52 through which the actuator card 60 extends to establish the driving connection between the armature 20 and the movable spring 37. The actuator card 60 has an extended width extending along substantially the full width of the partition 50 and is received through the slit 52 such that the actuator card 60 is allowed to slide horizontally in the lengthwise direction of the housing in response to the armature movement for contact closing and opening. The partition 50 includes a guide member 53 projecting on the opposite surfaces thereof 50 to form a groove 54 extending from the slit 52 in the opposite directions along the length of the housing, as best shown in FIG. 7, for slidably supporting the actuator card 60. That is, the guide member 53 has forward and rearward ribs 55 and 56 projecting toward the movable spring 37 and the armature 20, respectively. As best shown in FIGS. 8A and 8B, the guide member 53, i.e., the forward and rearward ribs 55 and 56 are formed along one width end portion of the of the partition 50 such that the groove 54 is only formed along the limited width end portion of the partition 50 and is cooperative with a corresponding end portion of the slit 52 to define a longitudinally extended guide for slidably supporting a corresponding width end portion of the actuator card 60 over an extended distance. The remaining width end portion of the partition 50 is free from any projection to leave on both sides thereof free spaces available for receiving the first leg 21 of the armature 20 and a nose extension 62 of the actuator card 60, respectively, as best shown in FIGS. 8A and 8B.

Figure 6:
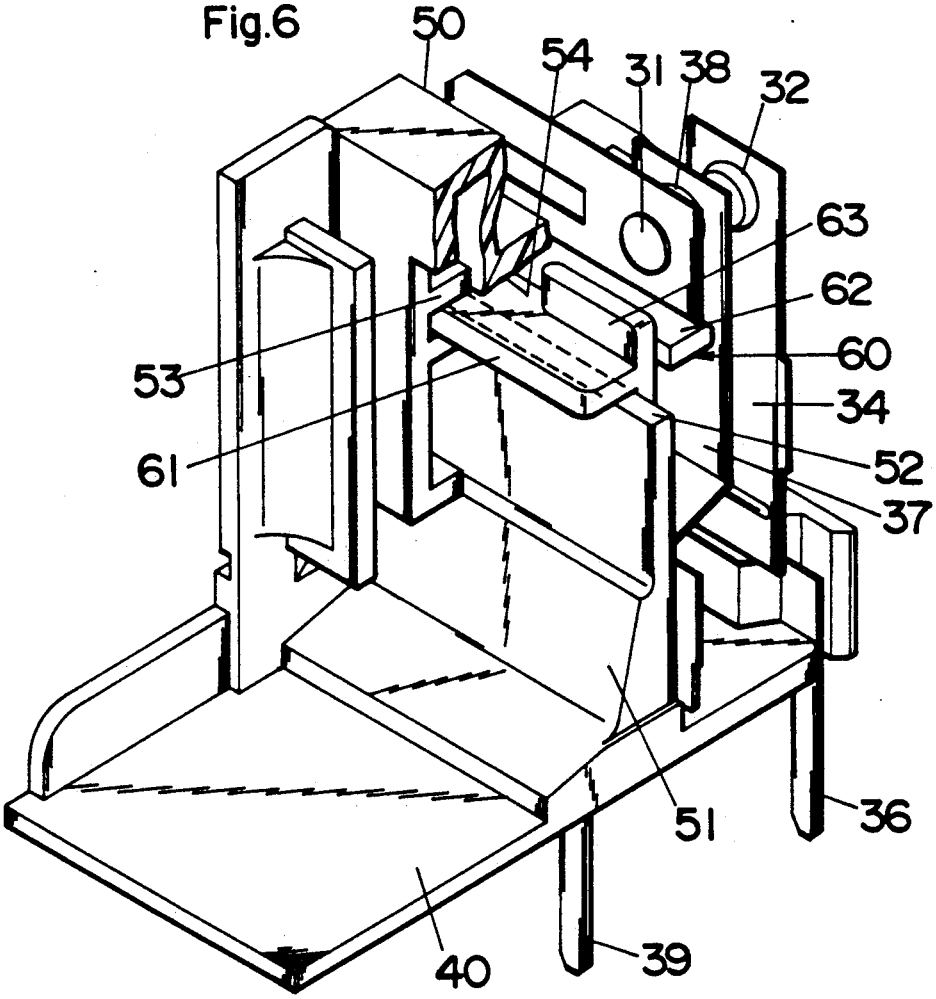
FIG. 6 is a perspective view, partly being broken, of a portion of the relay showing a supporting structure of a card.
Figure 9A:
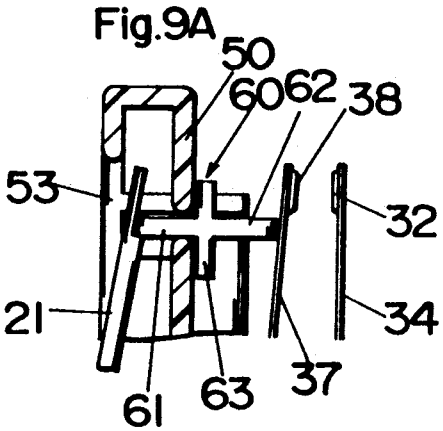
FIGS. 9A and 9B are respectively explanatory views illustrating the card movement for contact closing and opening as viewed from the front.
Figure 9B:
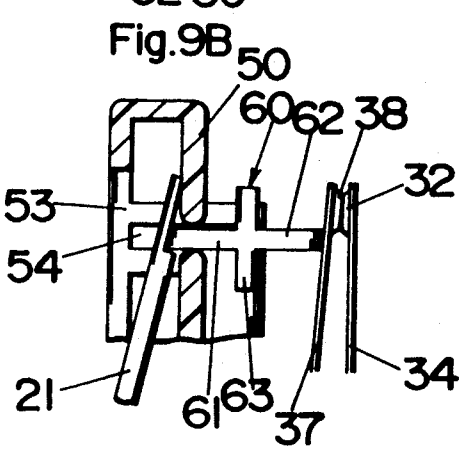

The actuator card 60 comprises a flat rectangular plate 61 with the nose extension 62 projecting from one width end portion in a direction perpendicular to the width direction for abutment with the upper end of the movable spring 37. Also, the actuator card 60 is formed with a pair of vertical fins 63 integrally extending upward and downward from the connection between the nose extension 62 and the flat plate 61 and having substantially the same width as the nose extension 62. As shown in FIG. 6, thus configured actuator card 60 is received through the slit 52 with one width end portion slidably supported in the extended guide so as to leave the other width end portion free from the guide member 53. The other width end portion including the nose extension 62 is held between the first leg 21 of the armature 20 and the movable spring 37 so as to be supported therebetween while extending through the slit 52, as shown in FIGS. 8 and 9. The vertical fins 63 are located forwardly of the slit 52 to conceal therebehind the slit 52 for completing the electrical insulation between the movable spring 37 and the first leg 21 made into the same width dimension as the vertical fins 63, as seen in FIGS. 9A and 9B.

In operation, when the armature 20 is in the reset position as the consequence of the coil 12 being kept deenergized, the first leg 21 of the armature 20 applies no substantial force to the actuator card 60, thereby retaining it in the position of FIGS. 8A and 9A to keep the movable contact 38 disengaged from the second fixed contact 32. Upon energization of the coil 12, the armature 20 is attracted to the set position for driving the actuator card 60 to move forwardly into the position of FIGS. 8B and 9B, thereby flexing the movable spring 37 to engage the movable contact 38 with the second fixed contact 38. The first fixed contact 31 (which is omitted from FIGS. 8 and 9 for a simplicity purpose) is engaged with the movable contact 38 at the reset position of the armature 20 and is disengaged therefrom at the set positions. During this contact closing and opening operation, the first leg 21 of the armature 20 is permitted to shift within a distance overlapped with the portion of the guide member 53 without being interfered therewith, as seen in FIGS. 8A, 8B, 9A and 9B, thereby effectively reducing a space requirement for supporting and driving the actuator card 60 in the sliding direction thereof while stably supporting the actuator card 60 by means of the guide member 53 in cooperation with the slit 52. Consequently, it is possible to miniaturize the relay with respect to the lengthwise direction along which the electromagnet 10 and the contact assembly 30 are arranged.

What is claimed is:

1. An electromagnetic relay, comprising:

a housing having a length and width;

a contact assembly mounted in said housing and including a fixed contact and a movable spring carrying a movable contact;

an electromagnet mounted within said housing in a side-by-side relation with said contact assembly along the length thereof, said electromagnet including an excitation coil and an armature which is movable between two contact operating positions in response to energization and deenergization of said excitation coil;

a card interposed between said armature and said movable spring to establish driving connection therebetween for engaging and disengaging said movable contact to and from said fixed contact in response to the armature movement;

a partition extending between said electromagnet and said contact assembly in a width direction of the housing for electrical insulation therebetween, said partition formed with a slit extending in the width direction thereof for receiving the card such that the card can slide through said slit for contact closing and opening in response to the armature movement; said card having an elongated width extending along the width of said partition and received through said slit; said partition being formed with a guide member extending along one width end portion of the slit and projecting in the sliding direction of said card so as to define an extended guide in cooperation with said width end portion of said slit for slidably supporting one corresponding width end portion of said card over an extended distance in the sliding direction, said card being engaged at the other width end portion spaced from said guide member with said armature in such a manner that said armature can move without being interfered with said guide member;

said card comprising an extended flat plate with a nose extension which projects in the sliding direction of said card from one width end portion of said flat plate remote from said guide member for abutment with said movable spring while leaving the remaining width end portion of said flat plate to be slidably supported by said extended guide, such that the engaging portion of said armature with said card is aligned in the sliding direction of said card with the engaging portion of said card with said movable spring.

2. An electromagnetic relay as set forth in claim 1, wherein said card has a pair of vertical fins which project from the connection between said flat plate and said nose extension in opposite directions substantially perpendicular to a plane of said flat plate and which are located outwardly of said slit so as to conceal said slit therebehind, said armature having a leg by which it is engaged with said card, and said leg is dimensioned to have substantially the same width as the width of said vertical fin in the width direction of said card.

* * * * *